United States Patent [19]

Yoshino et al.

[11] 4,252,351

[45] Feb. 24, 1981

[54] LOCKING AND UNLOCKING DEVICE

[75] Inventors: Muneki Yoshino, Toyokawa; Toshiji Taira, Toyota; Motoji Suzuki, Okazaki; Ichita Sogabe, Gifu, all of Japan

[73] Assignee: Nippondenso Co., Ltd., Kariya, Japan

[21] Appl. No.: 9,802

[22] Filed: Feb. 6, 1979

[30] Foreign Application Priority Data

Mar. 8, 1978 [JP] Japan ..... 53-26194

[51] Int. Cl.[3] ..... E05C 13/04

[52] U.S. Cl. ..... 292/336.3; 292/201

[58] Field of Search ..... 292/336.3, 201, 144, 292/DIG. 4

[56] References Cited

U.S. PATENT DOCUMENTS

| | | | |
|---|---|---|---|
| 2,741,930 | 4/1956 | Montooth et al. | 292/DIG. 4 |
| 3,039,290 | 6/1962 | Johnstone | 292/201 X |
| 3,384,405 | 5/1968 | Schiele | 292/201 X |
| 4,082,078 | 4/1978 | Thuleen et al. | 292/201 X |

FOREIGN PATENT DOCUMENTS

| | | | |
|---|---|---|---|
| 208163 | 4/1940 | Switzerland | 292/DIG. 4 |

*Primary Examiner*—Richard E. Moore

*Attorney, Agent, or Firm*—Cushman, Darby & Cushman

[57] ABSTRACT

A locking and unlocking device comprises an electromagnetic actuator which pulls in or pushes out an output rod thereof, a movement direction changing mechanism alternating the direction of its rotational movement with each of said pulling-in and pushing-out operations of said electromagnetic actuator, a lock lever rocking alternately in opposite directions with each of said pulling-in and pushing-out operations of said electromagnetic actuator, a main body of a locking apparatus linked with said lock lever and effecting locking and unlocking operations, position detector switch means linked with a moving part of said main body of said locking apparatus thereby being caused to change over with each of said locking and unlocking operations to control energization of said electromagnetic actuator, and operation switch means for initiating said locking and unlocking operations, respectively. The changing-over of said position detector switch means determines which operation switch means is subsequently operable.

8 Claims, 7 Drawing Figures

LOCKING AND UNLOCKING DEVICE

BACKGROUND OF THE INVENTION

1. Field of the Invention

This invention relates to an improvement of a locking and unlocking device applicable to the locking and unlocking of doors of automobiles, for example.

2. Description of the Prior Art

In conventional automobile door locking devices it has been common practice to adopt the structure comprising two actuators or an actuator constructed to effect pushing and pulling operations by having two exciting coils therein, for example, thereby to produce a force in two directions for locking or unlocking which is applicable to a locking and unlocking mechanism according to an unlocked or locked state of the door locking device, respectively. With such structure, the changing of the direction of application of the force has been achieved by energizing either one of the two actuators or of the two exciting coils according to the locked or unlocked state of the door locking device. However, the above-mentioned conventional structure requires the use of two actuators or two exciting coils, which gives rise to a grave drawback to increase cost and weight of a product using such a device. Such a drawback is a contradiction to a recent trend in the automotive industry to lower the weight of automobiles with the object of reducing production cost and improving fuel consumption.

SUMMARY OF THE INVENTION

The object of this invention is to provide, in view of the above-mentioned problem, a locking and unlocking device of small size, light weight and low cost using an actuator having simple structure to enable locking and unlocking of doors, etc. in which a movement direction changing mechanism is utilized to convert a unidirectional driving force of the actuator, which puts forth a unidirectional pulling-in or pushing-out force, into bidirectional driving forces.

This invention brings a remarkable advantage to provide a locking and unlocking device of low production cost and having a construction of small size and light weight as compared with a conventional construction using a reversible electric motor or two electromagnetic solenoids, since the use of a movement direction changing mechanism, which reverses the direction of its rotation with each of the pulling-in or pushing-out operations of the actuator, and the utilization of position detector switch means, which discriminates a locked or an unlocked state of a main body of a locking apparatus to control the energization of the actuator, make it possible to use a single actuator of a type putting forth simply a unidirectional driving force.

DESCRIPTION OF THE PREFERRED EMBODIMENTS

A locking and unlocking device embodying this invention will be described hereunder in conjunction with the accompanying drawings.

Figure 1:
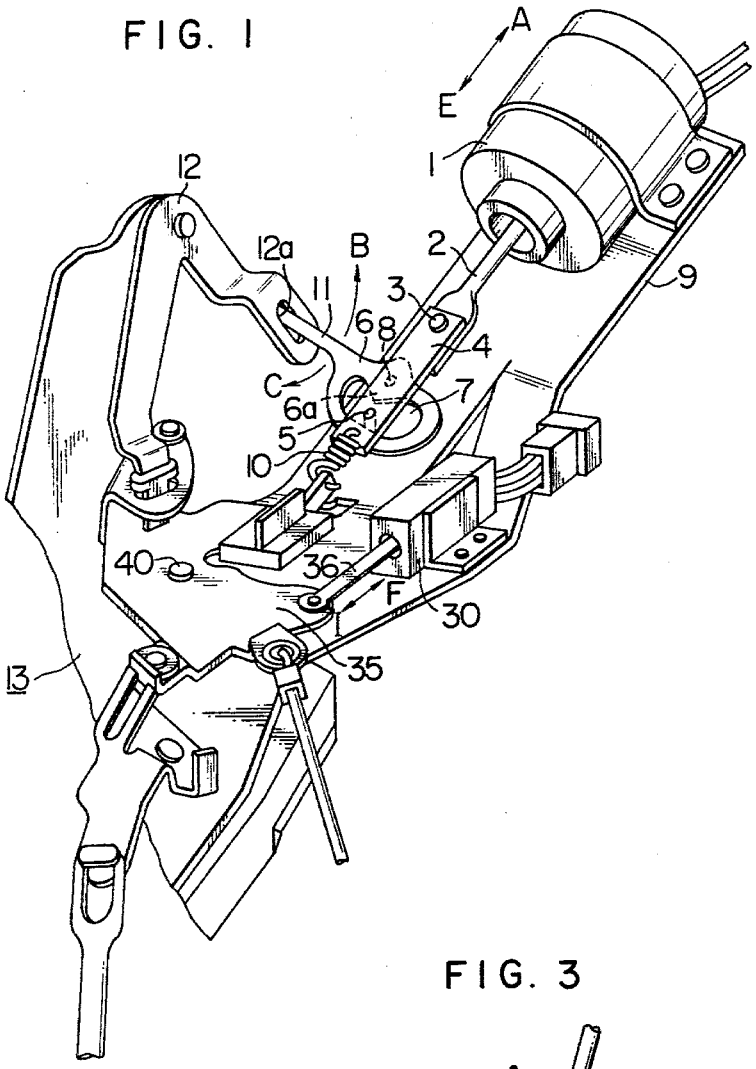
FIG. 1 is a partial perspective drawing showing a locking and unlocking device of an embodiment of this invention, particularly, a door locking device for use in automobiles.

In FIGS. 1 to 6, numeral 1 designates an actuator, particularly, a publicly known electromagnetic solenoid whose output rod 2 is pulled in and moves in the direction of an arrow A upon excitation of a coil of the electromagnetic solenoid. Numeral 3 designates a pin connecting a rotatable lever 4 with the output rod 2. The rotatable lever 4 is able to rotate with the pin 3 as an axis of its rotation. Numeral 5 designates a stud fixed onto the rotatable lever 4. Numeral 6 designates a rocker plate having a heart-shaped opening 7 and a triangular tonguelet **6*a* protruding in the opening 7, and the stud 5 is inserted in the heart-shaped opening 7. Numeral 8 designates a rivet which engages the rocker plate 6 with a support plate 9 fixed onto an automobile body so that the rocker plate 6 may rotate around the rivet 8 on the support plate 9. Thus, the rocker plate 6 is made to rock left and right around the rivet 8. Numeral 10 designates a spring one end of which is fixed to a swinging end of the rotatable layer 4 and the other end of which is connected to the support plate 9 which is fixed onto the automobile body as described above. The rocker plate 6 has an arm 11 incorporated therewith at the left side of the rivet 8. Numeral 12 designates a lock lever one of whose lever arms engages with the arm 11 of the rocker plate 6 to be driven by the latter and the other of whose lever arms engages with a moving part of a main body 13 of a locking apparatus to drive it. The main body 13 of the locking apparatus is a commonly known door locking apparatus for use in automobiles. A portion of the arm 11 of the rocker plate 6 is inserted in a hole 12*a* provided in the said one of the lever arms of the lock lever 12. Thus, when the rocker plate 6 performs a rocking motion, the arm 11 and the lock lever 12 are driven together to make the main body 13 of the locking apparatus effect locking and unlocking operations. The main body 13 performs a locking operation when the lock lever 12 is turned in the direction of an arrow B and an unlocking operation when the lock lever 12 is turned in the direction of an arrow C, as shown in FIG. 1**.

Figure 6:
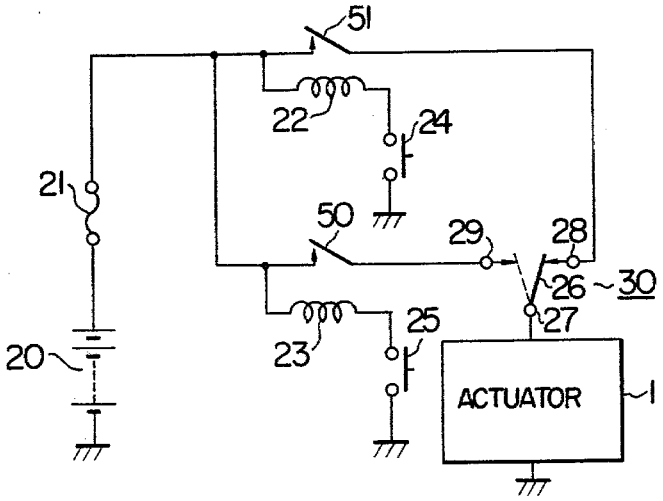
FIG. 6 is a wiring diagram showing an electric circuit used in the device shown in FIG. 1.

Next, in the wiring diagram of FIG. 6, numeral 20 designates a battery used as an electric power source for automobiles, 21 a fuse, 22 and 23 relay coils, and 24 and 25 a locking operation switch and an unlocking operation switch, respectively.

Numeral 30 designates a position detector switch, and 26 a change-over contact, and 27, 28 and 29 stationary contacts, respectively, of the position detector switch 30.

Figure 4:
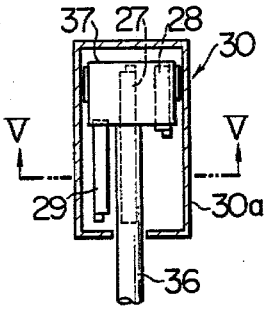
FIGS. 4 and 5 are, respectively, a longitudinal section showing position detector switch means used in the device shown in FIG. 1 and a cross-sectional view taken along the cutting-plane line V—V and viewed in the direction of arrows shown in FIG. 4, respectively.
Figure 5:
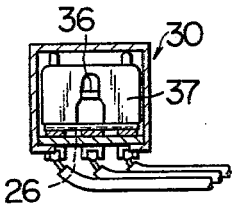

Here, the internal structure of the position detector switch 30 will be described by making reference to FIGS. 4 and 5. A detection lever 36 has one end thereof rotatably linked with a right side end of a lever 35 of a moving part of the main body 13 of the locking apparatus as shown in FIG. 1. The other end of the detection lever 36 is inserted in a case 30*a* of the position detector switch 30. Further, in the case 30*a* there is contained the change-over contact 26 which is movably supported and connected with the detection lever 36 with an insulator member 37 intervening therebetween. There are also arranged in the case 30*a* three stationary contacts 27, 28 and 29 to be opposite to the change-over contact 26, and the stationary contacts 27, 28 and 29 comprises rail-shaped conductor slips which maintain sliding contact with the change-over contact 26.

Figure 2:
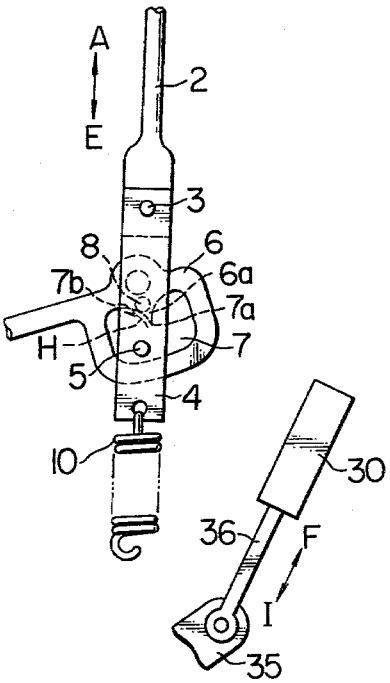
FIG. 2 is a partial plan showing a principal part of the device shown in FIG. 1 when it is in an unlocked state.

Now, the operations performed with the above-described construction of the device of this invention will be explained hereunder. The explanation will start from a state where the main body 13 of the locking apparatus is unlocked. In such a state, the rocker plate 6 constructed as a movement direction changing mechanism, the rotatable lever 4, the stud 5, the heart-shaped opening 7 and the spring 10 take their respective positions as shown in FIG. 2. Namely, the rotatable lever 4 and the output rod 2 of the actuator 1 connected with the rotatable lever 4 by the pin 3 are pulled by the spring 10 in the direction of an arrow E. The stud 5 incorporated with the rotatable lever 4 and protruding downward therefrom is situated slightly leftward with respect to a projecting end 7*a* of the triangular tonguelet 6*a* at the upper central wall of the heart-shaped opening 7.

Figure 3:
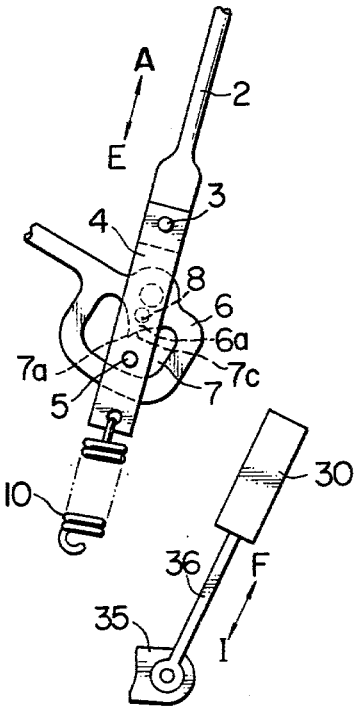
FIG. 3 is a partial plan showing a principal part of the device shown in FIG. 1 when it is in a locked state.

The detection lever 36 of the position detector switch 30 is pushed in the direction of an arrow F shown in FIG. 1 by the lever 35 of the moving part of the main body 13 of the locking apparatus which rotates with a rivet 40 fixed onto the support plate 9 as a center of its rotation. In the case 30*a* of the position detector switch 30 the change-over contact 26 bridges the stationary contacts 27 and 28 as shown in FIG. 6. In such a state, even if a driver of a vehicle, on which the locking and unlocking device is mounted, should turn on the unlocking operation switch 25 to energize the relay coil 23 and thereby close a relay contact 50, the actuator 1 remains unoperated, because the actuator 1 and the relay contact 50 are disconnected from each other by the position detector switch 30. On the other hand, if the locking operation switch 24 is turned on to energize the relay coil 22 and thereby close a relay contact 51, an electric current flows through the battery 20, the fuse 21, the relay contact 51, the stationary contact 28, the change-over contact 26, the stationary contact 27 and the coil of the electromagnetic solenoid of the actuator 1, thereby operating the actuator 1 to pull in the output rod 2 in the direction of the arrow A in FIG. 2. At the same time, the rotatable lever 4 is drawn together with the output rod 2 in the same direction to cause the stud 5 to be pushed against the upper left wall 7*b* of the heart-shaped opening 7 and then to travel along the wall 7*b* in the direction of an arrow H as shown in FIG. 2. As a result, the rocker plate 6 is made to rotate clockwise, because the condition of its rotational movement is established with the rivet 8 as a centre of its rotation and with a point of contact on the surface of the wall 7*b*, where the stud 5 pushes against the wall 7*b*, as a point of application of a driving force. Consequently, the lock lever 12 is turned in the direction of the arrow B shown in FIG. 1 thereby shifting the main body 13 of the locking apparatus from the thus far unlocked state to a locked state. At the same time, the detection lever 36 of the position detector switch 30 is pulled out in the direction of an arrow I, which causes the change-over contact 26 connected with the detection lever 36 to shift slidably on the stationary contacts 27, 28 and 29 so that the change-over contact 26 completely leaves the stationary contact 28 after the change-over contact 26 has been brought into contact with the stationary contacts 27 and 29 in FIG. 6. When the change-over contact 26 is completely separated from the stationary contact 28, power supply to the actuator 1 is interrupted, so that the output rod 2 and the rotatable lever 4 are drawn together in the direction of the arrow E by the elastic force of the spring 10, and thus the stud 5 stops at a position such as shown in FIG. 3. Namely, the stud 5 takes a position somewhat on the right side with respect to the central wall portion 7*a* of the heart-shaped opening 7.

Next, if the unlocking operation switch 25 is turned on to energize the relay coil 23 and thereby close a relay contact 50, an electric current flows through the battery 20, the fuse 21, the relay contact 50, the stationary contact 29, the change-over contact 26, the stationary contact 27 and the coil of the electromagnetic solenoid of the actuator 1, thereby operating the actuator 1 to pull in the output rod 2 in the direction of the arrow A in FIG. 3. At the same time, the rotatable lever 4 is drawn together with the output rod 2 in the same direction, which in this case causes the stud 5 to travel rightward along the upper right wall 7*c* of the heart-shaped opening 7. Accordingly, the rocker plate 6 is made to rotate anticlockwise with the rivet 8 as the center of its rotation. As a result, the lock lever 12 is turned in the direction of the arrow C shown in FIG. 1 to shift the moving part of the main body 13 of the locking apparatus from the locked state to the unlocked state.

Simultaneously with the shifting of the state of the moving part of the main body 13 of the locking apparatus, the position detector switch 30 is operated so that the change-over contact 26 leaves the stationary contact 29 after the change-over contact 26 has bridged both stationary contacts 27 and 28. When the change-over contact 26 is completely separated from the stationary contact 29, the actuator 1 is de-energized, and the rotatable lever 4 and the output rod 2 are drawn together by the elastic force of the spring 10 in the direction of the arrow E. As a result, the stud 5 is moved together and stops at a position near the inner wall of the opening 7 opposite to the tonguelet 6*a* and somewhat on the left side with respect to the central wall portion 7*a* of the opening 7 as shown in FIG. 2.

In this way, in the case of the unlocking operation, for example, when the output rod 2 is pulled in the direction of the arrow A, the stud 5 is moved completely into the innermost recess of the upper right wall 7*c* of the heart-shaped opening 7 thereby to make the rocker-plate 6 rotate anticlockwise without fail and then let the same remain surely in the unlocked position. Namely, it is possible to surely shift the main body 13 of the locking apparatus into the unlocked state and to maintain the rocker-plate 6 at a position, to which it has been driven, and prevent its returning to a previous position until the actuator 1 is energized again, thereby assuring a fail-proof unlocking operation. A similar functional effect can be obtained also in the case of the locking operation.

Figure 7:
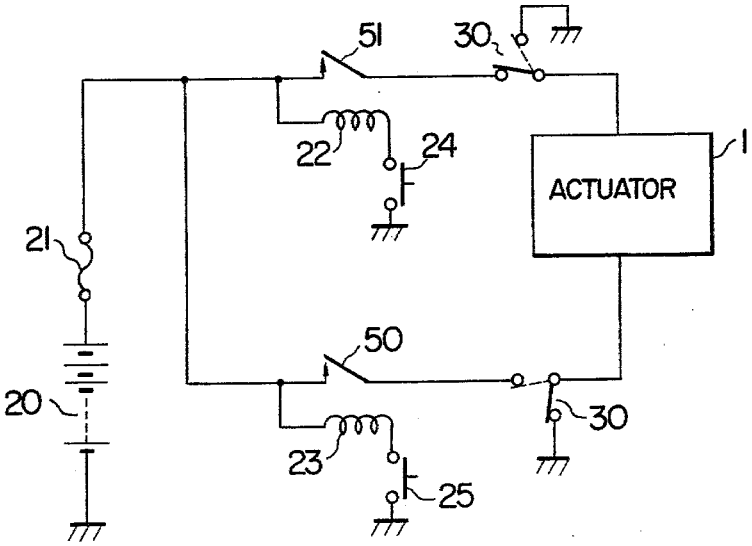
FIG. 7 is a wiring diagram showing another embodiment of the electrical construction of the device of this invention.

The electric circuit available for this invention is not confined to the one shown in FIG. 6. An alternative electric circuit shown in FIG. 7, for example, may be adopted instead of the electric circuit of FIG. 6. Only, in the case of the electric circuit of FIG. 7 the current flowing through the coil of the actuator 1 can take two opposite directions. However, the operation of the actuator 1 to pull in the output rod 2 remains unchanged, even if the direction of the exciting current flowing through the coil may be changed.

The foregoing embodiments have been described with respect to a door locking device. However, of course, they are also applicable to an automobile trunk-lid unlocking device and an automobile fuel tank filler cap locking and unlocking device, etc.

A rotary solenoid may be used in place of the electromagnetic solenoid described above, whereby the stud 5 may be made to move reciprocally by a rocking lever driven by the rotary solenoid.

In the above-described embodiments the electromagnetic solenoid is used as the actuator 1 to produce a force in the pulling-in direction, but it may also be possible to use one which produces a force in the pushing-out direction.

Further, in the above-described embodiments a position detector switch having a slide switch mechanism is used as position detector switch means. However, it may also be possible to use another switch with contacts such as a microswitch, etc. or to use a contactless switch such as a publicly known proximity switch. Besides, the position detector switch means may comprise a relay controlled by the above-mentioned switch with contacts or contactless switch.

In addition, when it is necessary to effect locking and unlocking operations at a plurality of positions, it is possible to use two or more locking and unlocking operation switches connected in parallel, respectively.

We claim:

1. An arrangement for operating a locking apparatus for locking and unlocking a latch comprising:

an actuator operating to pull in or push out an output rod thereof;

a movement direction changing mechanism alternating the direction of its rotation with each of said pulling-in and pushing-out operations of said actuator;

a lock lever engaged with said movement direction changing mechanism and alternating its drawing and thrusting operations with each of said pulling-in and pushing-out operations of said actuator, said lock lever for operating said locking apparatus and causing said locking apparatus to lock and unlock;

position detector switch means for detecting whether said locking apparatus is in a locked or an unlocked state and electrically connected to said actuator to control energization of said actuator; and operation switch means for controlling electric power supply to said position detector switch means.

2. A locking and unlocking device wherein a lock lever is made to rock by the movement of an output shaft of an electromagnetic solenoid, thereby effecting locking and unlocking of a main body of a locking apparatus, said locking and unlocking device comprising:

a movement direction changing rocker member engaged with said lock lever and rocking around a fixed support thereby to cause the rocking movement of said lock lever and having a triangular tonguelet positioned adjacent to said fixed support and projected in a direction opposite to said electromagnetic solenoid;

a stud linked with said output shaft of said electromagnetic solenoid to be actuated by the same and pushing against and sliding along alternately either one of left and right side walls of said triangular tonguelet thereby driving said movement direction changing rocker member when said electromagnetic solenoid is energized;

a spring member drawing said stud off the side walls of said tonguelet of said movement direction changing rocker member when said electromagnetic solenoid is de-energized;

locking switch means which is closed when said main body of said locking apparatus is to be locked;

unlocking switch means which is closed when said main body of said locking apparatus is to be unlocked; and locked or unlocked state detecting switch means for detecting whether said main body of said locking apparatus is in a locked or an unlocked state and controlling a current supplied through said locking or unlocking switch means and flowing through said electromagnetic solenoid to energize the same, whereby said stud is moved by said output shaft of said electromagnetic solenoid to drive said movement direction changing rocker member thereby shifting said main body of said locking apparatus either from a locked state to an unlocked state upon closing of said unlocking switch means when said main body of said locking apparatus is in a locked state or from an unlocked state to a locked state upon closing of said locking switch means when said main body of said locking apparatus is in an unlocked state.

3. A locking and unlocking device according to claim 2, wherein said movement direction changing rocker member has a heart-shaped opening and said stud is inserted in said opening.

4. A locking and unlocking device according to claim 2, wherein said locked or unlocked state detecting switch means comprises change-over switch means operating so that, after one current path thereof has been closed, the other current path thereof, which has been in a closed state, is opened.

5. A locking and unlocking device according to claim 4, wherein said locked or unlocked state detecting switch means comprises a slide switch operably engaged with said main body of said locking apparatus through an interlinking lever.

6. A locking and unlocking device for operating a main body of a locking apparatus between locked and unlocked states comprising:

an electrically operated actuator operating to pull in or push out an output rod thereof, thereby changing said main body of said locking apparatus between said locked and unlocked states;

a movement direction changing mechanism alternating the direction of its rotation at every pulling-in and pushing-out movement of the output rod of said actuator;

a lock lever having one end thereof engaged with said movement direction changing mechanism and the other end thereof for operating a moving part of said main body of said locking apparatus, thereby alternating drawing and thrusting operations of said moving part of said main body of said locking apparatus at every pulling-in and pushing-out movement of the output rod of said actuator;

position detector switch means detecting whether said main body of said locking apparatus is in a locked or an unlocked state and electrically associated with said actuator to control energization of said actuator; and operation switch means for controlling a supply of electric power to said position detector switch means.

7. In a locking and unlocking device wherein a lock lever alternates drawing and thrusting operations of a moving part of a main body of a locking apparatus engaged with said lock lever at every pulling-in and pushing-out movement of an output rod of an actuator, thereby effecting locking and unlocking of said main body of said locking apparatus, an improvement comprising:

a movement direction changing mechanism engaged with said lock lever and alternating the direction of its rotation at every pulling-in and pushing-out movement of the output rod of said actuator thereby causing said lock lever to rock;

position detector switch means for detecting whether said main body of said locking apparatus is in a locked or an unlocked state and electrically connected to said actuator to control energization of said actuator; and operation switch means for controlling electric power supply to said position detector switch means.

8. An arrangement according to any of claims 1–6 further comprising a locking apparatus for locking and unlocking a latch.

* * * * *